United States Patent [19]

Diesinger et al.

[11] 4,133,265

[45] Jan. 9, 1979

[54] TRAINING PROJECTILE

[75] Inventors: Walter Diesinger; Axel Homburg, both of Bergisch Gladbach, Germany

[73] Assignee: Dynamit Nobel AG, Germany

[21] Appl. No.: 749,424

[22] Filed: Dec. 10, 1976

[30] Foreign Application Priority Data

Dec. 19, 1975 [DE] Fed. Rep. of Germany ..... 2557293

[51] Int. Cl.[2] ..... F42B 13/20

[52] U.S. Cl. ..... 102/92.7; 102/49.3

[58] Field of Search ..... 102/41, 49.1–49.3, 102/49.8, 92.7

[56] References Cited

U.S. PATENT DOCUMENTS

| | | | |
|---|---|---|---|
| 466,056 | 12/1891 | Bott | 102/49.3 |
| 2,470,489 | 5/1949 | Hopkins | 102/49.8 |
| 2,821,924 | 2/1958 | Hansen et al. | 244/3.28 |
| 3,200,747 | 8/1965 | Sorenson et al. | 102/49.4 |
| 3,245,350 | 4/1966 | Kelly | 102/49.3 |
| 3,334,587 | 8/1967 | Stadler et al. | 102/41 |

*Primary Examiner*—Verlin R. Pendegrass

*Attorney, Agent, or Firm*—Craig & Antonelli

[57] ABSTRACT

A training projectile having an auxiliary drive mechanism for counteracting the aerodynamic resistance to which the projectile is exposed during the training flight phase of projectile travel. The auxiliary drive mechanism preferably is in the form of a rocket or jet drive. The training projectile is also provided with a mass so that the ratio of the resultant axial force to the mass of the training projectile is at least approximately equal to the ratio of the resistance force to the mass of a corresponding live projectile during the training flight phase.

25 Claims, 12 Drawing Figures

TRAINING PROJECTILE

The present invention relates to a training projectile.

Ammunition is known for practice or training purposes which, in the firearm, exhibits a behavior identical to the corresponding live or original ammunition, but wherein the range of the projectile is reduced, and thus the danger zone is decreased, to such an extent that the projectile can also be utilized on a practice range having a minor spatial expansion. These training projectiles generally possess initially a lower mass than the live or original projectile, but in certain cases the mass can also be reduced only during flight. In this connection, a disadvantage is encountered in some cases in that, in the flight phase within the practice range, namely the so-called training flight phase, the curves of the trajectory and of the velocity of the more lightweight training projectiles do not coincide with those of the heavier original shells, or do not come sufficiently close thereto, or that the expenses for manufacturing the training projectiles are undesirably high and the functional reliability required in individual cases is not provided in all instances.

It is therefore an object of the present invention to fashion a training projectile so that its trajectory and velocity curves in the training flight phase come maximally close to those of the original projectile and, especially, are even identical thereto.

Another object of the present invention is to provide a training projectile which, after traveling a predetermined distance, is strongly braked to keep the safety range or impingement distance of the training ammunition small.

A further object of the present invention is to provide a training projectile which is producible with comparatively minor expenditures and is maximally safe in its function.

In accordance with the present invention, a training projectile is provided with an auxiliary drive mechanism which counteracts the aerodynamic resistance or drag force to which the projectile is exposed during the training flight phase, so that the ratio of the resultant axial force to the mass of the training projectile is at least approximately equal to the ratio of the resistance force to the mass in case of the original projectile. The mass of the training projectile of this invention is preferably already initially, i.e. already during firing, smaller than that of the original projectile, but it can also be initially larger, in which case a corresponding reduction of the mass during flight is necessary. The aerodynamic resistance of the training projectile is thus compensated, in part, in correspondence with its smaller mass. This compensation takes place, in accordance with this invention, only during the training flight phase wherein the training projectile flies along the same or anyway approximately the same ballistic path as the live or original shell. Outside of the training flight phase, the undiminished aerodynamic resistance force is effective on the training projectile, so that it is braked, in correspondence with its smaller mass, to a greater extent than the original projectile, and thus the trajectory is shortened to the desired degree. The training projectile preferably has the same external configuration and thus the same aerodynamic resistance as the original shell. However, the training projectile can also exhibit a resistance behavior which deviates therefrom.

The resultant axial force effective on the training projectile during the training flight phase is equal to the aerodynamic resistance force, reduced by the thrust of the auxiliary drive mechanism of this invention. Depending on the design of the auxiliary drive mechanism, it is possible to select the ratio of the resultant axial force to the mass of the training projectile as large as the ratio of the aerodynamic resistance force to the mass in case of the live or original projectile, or to effect merely a greater or lesser approximation of the latter. Thus, it is possible advantageously to determine the degree of coincidence between the ballistic paths of the training projectile and the original projectile in correspondence with the individual requirements. In other words, the training projectile can be constructed so that its trajectory and velocity curves in the training flight phase approach those of the original projectile or are even identical thereto.

The auxiliary drive mechanism, in case of a spin-stabilized training projectile, can be fashioned, for example, so that the spin energy is converted into thrust. For this purpose, the training projectile can be provided, for example, with propeller vanes which can be swung out after the projectile has left the barrel. However, in an advantageous embodiment of the invention, the provision is made to fashion the auxiliary drive mechanism as a rocket or jet propulsion mechanism. The special rocket drive mechanism offers not only the advantage of being usable even in spin-free training projectiles, but also the possibility of a free choice of the chronological thrust characteristic and thus of an improved adaptation to the requirements of the respective training ammunition. Moreover, this feature has the further advantage that, due to the driving jet of the rocket propulsion mechanism, the mass of the training projectile is reduced during the training flight phase, so that the projectile is even more decelerated at the end of the training flight phase by the aerodynamic resistance force, which results in an even shorter residual flight path.

The jet or rocket propulsion mechanism described herein can basically be designed, for example, in the manner of a cold gas propulsion mechanism. For this purpose, the training projectile is fashioned as a container having a nozzle sealed by a diaphragm at its rear end and filled with a compressed gas, e.g. air. The diaphragm is disintegrated, for example, upon firing, so that the compressed gas, after the training projectile has left the barrel, can stream toward the rear out of the container, which latter preferably has the external shape of the original projectile, and can drive the container. In correspondence with the internal pressure of the container, which drops during the ejection, the thrust exerted on the training projectile is reduced just as the mass of the latter.

In accordance with another feature of the present invention, the training projectile is constructed as a container with at least one nozzle arranged in the zone of its rearward end face and the auxiliary drive mechanism is fashioned in the form of a hot gas propulsion mechanism wherein the propellant gases of the propellant charge of the projectile proper and/or of an additional solid propellant charge arranged in the interior of the container serve for filling the container so to speak automatically with compressed gas during firing. This eliminates the filling of the container prior to firing, as is necessary in case of a cold gas propulsion mechanism. To improve the filling step within the barrel of the firearm, the container is provided with at least one check valve which increases the inlet cross section for the propellant gases of the propellant charge of the projectile with respect to the outlet cross section of the at least one nozzle, preferably by a multiple.

A further advantageous embodiment of the training projectile according to this invention utilizes a solid propellant charge with a degressive thrust characteristic. The chronological reduction of the burning area of the solid propellant charge can be determined so that the thrust exerted on the training projectile is decreased in correspondence with the reduction in its mass and the aerodynamic resistance force diminishing with the square of the velocity, thus providing the required adaptation of the ballistic trajectory of the training projectile to that of the original projectile, or even its coincidence during the training flight phase. The solid propellant charge with the associated nozzle is arranged, for example, at the rear end of the training projectile. The latter here again is preferably fashioned as a hollow component, so that it has a maximally minor mass in its burnt-out condition, in order to be then strongly braked. However, this feature can be omitted, i.e. the training projectile can be fashioned, for example, also as a solid body with a mass which is reduced as compared to the original projectile, if in an individual instance there is no such great requirement for an extensive reduction of the firing range.

According to another feature of the present invention, the solid propellant charge is arranged in the ogive of the training projectile, in particular, in the zone of the forward end within the projectile, and has the advantage, inter alia, that due to the outer surface of the solid propellant charge in contact with the projectile wall and curved in the same manner as the ogive or similarly thereto, the burning area of this solid propellant is positively reduced, whether the propellant is fashioned as an end burner or an internal burner, i.e. the thrust curve is already degressive without any additional correctional measures, so that in certain cases no further measures are necessary, or only minor steps have to be taken. Depending on the acceleration forces occurring during firing, it can be advantageous to support the solid propellant charge toward the rear by means of a bottom which, in turn, is firmly joined to the body of the projectile, for example, by means of screws, flanges, or the like.

Another advantage of the aforedescribed training projectiles of this invention resides in that, in case of a failure of the auxiliary drive mechanism, they proceed initially along a short trajectory due to their smaller mass and do not cause any damage. The representation of the initial phase of the trajectory of the heavy original projectile by a driven, lightweight training projectile thus does not entail a risk of reliability as is the case with a training projectile which is actively affected after the training flight phase, for example by bursting, the extension of aerodynamic brake means, or the ignition of braking rockets.

The auxiliary drive mechanism of this invention can be the weaker, the smaller the difference between the masses of the original projectile and the training projectile initially. Therefore, it can be advantageous in some applications to replace the compressed gas of the training projectile fashioned as a container partially by a fluid supportive mass of greater density, for example water, which is driven out toward the rear of the training projectile after firing. For this purpose, the training projectile can be constructed advantageously as a container partially filled with a fluid. The container includes a conduit emanating from an outlet opening provided in the zone of the rearward end face of the container and extending toward the front, through which the fluid can be forced out toward the rear under the effect of a pressure medium present in the container. The fluid is to have a maximally neutral behavior within the training projectile, i.e. it must not damage the latter, for example, by corrosion, and it must not represent a danger to the environment upon ejection. It is possible in this way to fashion the training projectile, in spite of the available thrust impulse which is minor as compared to a gas drive mechanism, so that it is especially lightweight after the fluid has been driven out, i.e. at the end of the thrust action, which leads to a steep and thus short final trajectory. In this connection, however, it is to be considered that, due to the relatively large initial mass of this training projectile, the flight path of the latter is lengthened in case of a failure of the ejection means, in which case the maximum safety range must not be exceeded, either, of course.

The present invention is illustrated in the drawings in several embodiments and will be explained in greater detail below with reference thereto. The training projectiles, the external configuration of which coincides with that of the original projectiles, are shown in a schematic representation in longitudinal sectional views, wherein the intersected walls are generally represented as simple lines. In the drawings.

FIGS. 3*a*–6 show training projectiles with a solid propellant charge;

FIGS. 7–10 show training projectiles with gas propulsion mechanisms; and

Figure 11:
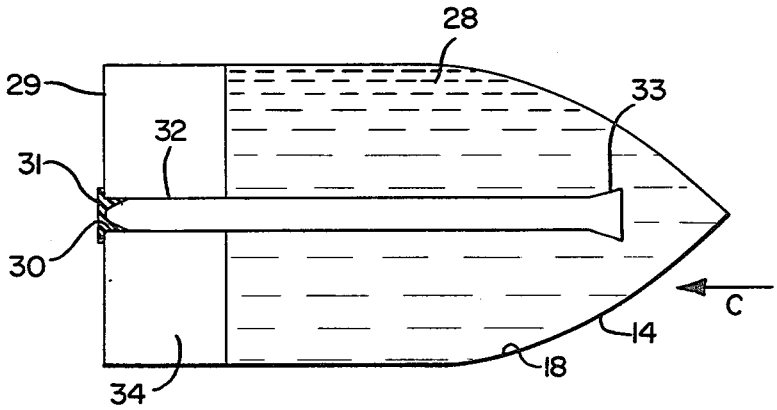

FIG. 11 shows a training projectile with a liquid supportive mass.

Figure 1:
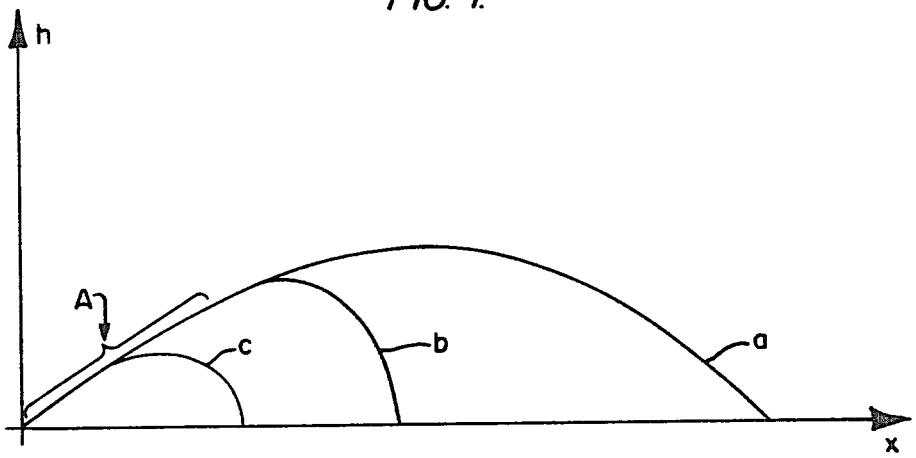
FIG. 1 shows the trajectories of the original projectile and the training projectile.

In FIG. 1, the firing elevation h is plotted with respect to the firing range x. Curve a shows the trajectory of the original projectile, and curves b and c show the trajectory of the training projectile of this invention, respectively, in a qualitative representation. In the zone A, which is the training flight phase, the curves a and b are congruent. In this zone, both projectiles also exhibit the same flight velocities. In case of curve c the assumption is made that the auxiliary drive mechanism of the training projectile has failed, and the projectile has a mass which is small as compared to the original projectile, so that it is strongly braked right from the beginning due to the aerodynamic resistance, thus having a correspondingly shortened trajectory.

The aerodynamic resistance force acting on the projectiles decreases with the square of the reduction in velocity. Furthermore, in case of a training projectile having a rocket propulsion mechanism, the mass is a monotonously decreasing function of the time, because the generation of the thrust ensues in a reduction in mass, for example a consumption of propellant. Therefore, the thrust exerted on the training projectile by the auxiliary drive mechanism must also drop correspondingly with the flying time t. The required thrust F to simulate the trajectory of a heavier original projectile by a more lightweight training projectile thus proceeds along the qualitative chronological curve shown in FIG. 2.

Figure 3A:
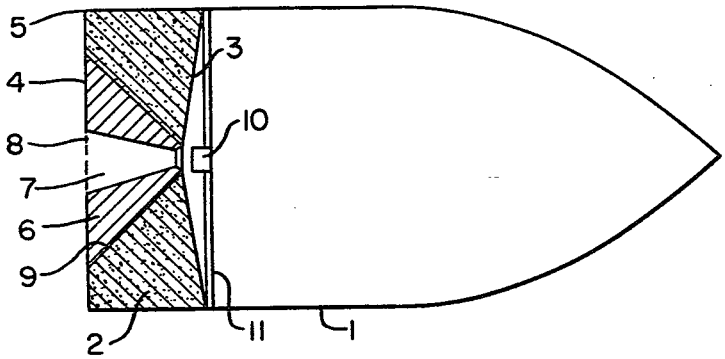

Referring now to the figures of the drawings which illustrate training projectiles and wherein like reference numerals designate like parts, FIG. 3*a* shows a training projectile fashioned as a hollow component with a wall 1 preferably formed of a light metal, e.g. an aluminum alloy, so that it has a minimally small mass at the end of the training flight phase. In the zone of the rear end of the training projectile, there is arranged a solid propellant charge 2 with an initial burning area 3, which is fashioned as an end burner. This propellant charge is supported on the bottom part 4 toward the rear, the bottom part being threadedly inserted, for example, with its rim 5 in the wall 1. A contoured element 6 containing a nozzle 7 as the inner contour is connected with the bottom 4. The latter is provided with an opening 8 in the region of the nozzle 7. The opening 8 is indicated by a dashed line and could optionally be covered by a diaphragm which can be disintegrated during firing. The outer contour 9 of the contoured element 6 is fashioned so that the burning area of the solid propellant charge 2 in contact with the contoured element 6 is reduced, during the burning period, in correspondence with the required thrust curve. The contoured element 6 is produced preferably of a light metal, e.g. an aluminum alloy, and is provided on its outer contour 9 for example with a ceramic coating for heat protection. The propellant charge 2 can be ignited directly by the propellant or barrel gases of the firearm, preferably a cannon, or also by a special ignitor 10 mounted to an intermediate bottom part 11 which latter is threadedly inserted in the projectile, for example.

Figure 2:
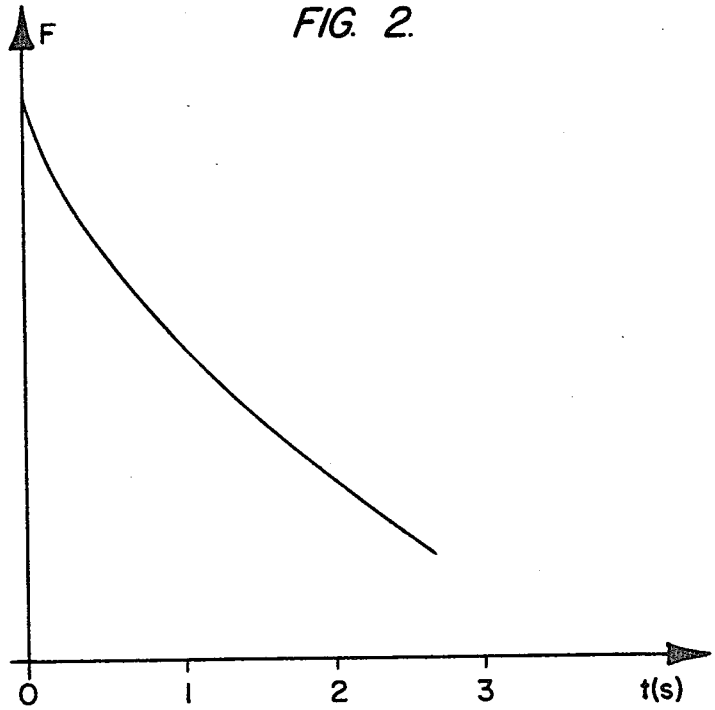
FIG. 2 shows the thrust curve of the auxiliary drive mechanism.
Figure 3B:
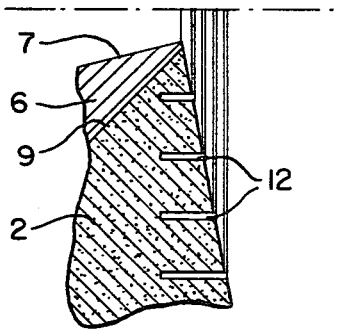

If the burning area at the beginning of the burning period is insufficient for producing the relatively high initial thrust which is to be provided as shown in FIG. 2, the end burner surface can be artificially enlarged, for example by undulations, spikes, or, as shown in a fragmentary view in FIG. 3*b*, by annular milled-out portions 12.

Figure 4:
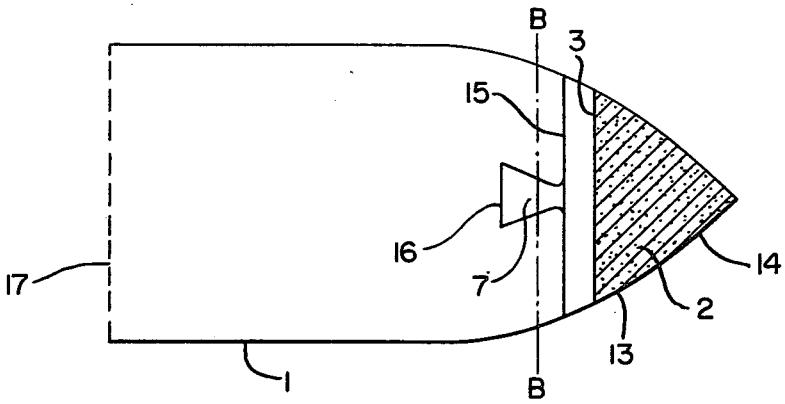

If it is desirable to place the center of gravity of the training projectile maximally toward the front, then the solid propellant charge 2, fashioned as an end burner, can be displaced in accordance with FIG. 4 into the zone of the front end 13 of the training projectile and can be glued, for example, directly into the cone or ogive 14 of the projectile with the interposition of a burn insulation. An intermediate bottom part 15 provided with a nozzle 7 is arranged at a spacing from the initial burning area 3. The intermediate bottom part 15 is inserted in the projectile fashioned as a hollow component, for example by threading. The nozzle 7 is sealed with a diaphragm 16 which can be destroyed upon firing, for example an aluminum foil. The projectile is open at the rear end 17, as indicated by the dashed line, so that the barrel gases of the firearm can flow into the projectile and the exhaust gases of the nozzle 7 can exit therefrom. To avoid an overexpansion of the gases after their exit from the nozzle 7, the wall 1 of the training projectile can optionally be provided in the zone of dashed-dot line B—B with radial openings in a conventional manner to vent the nozzle 7. This arrangement of the propellant charge 2 furthermore affords the advantage that, due to the cross sectional size of the charge which decreases toward the front on account of the contour of the ogive 14, the degressive thrust characteristic can be realized in a comparatively simple manner.

Figure 5:
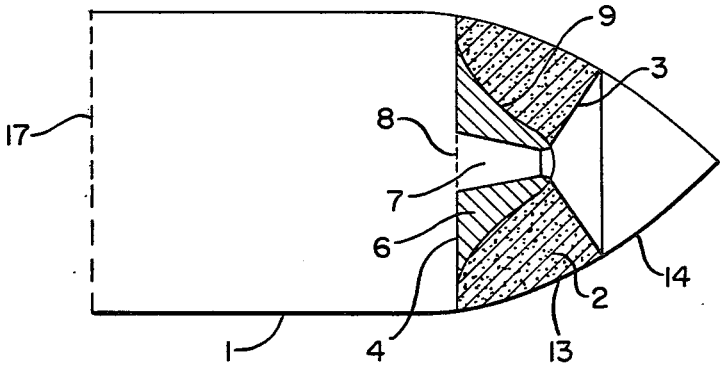
Figure 6:
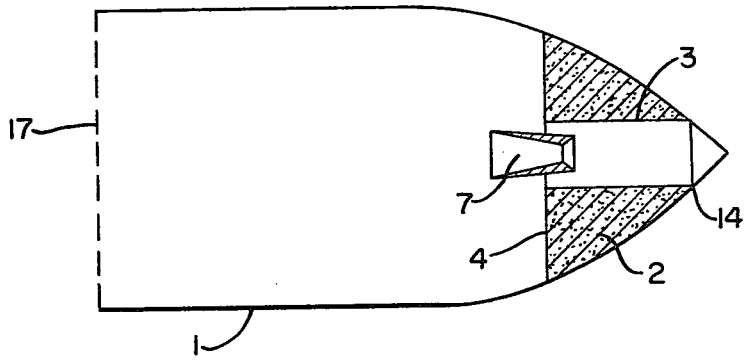

If, in case of an arrangement of the propellant charge in accordance with FIG. 4, the acceleration stability during firing is not ensured, combinations of the arrangements of FIGS. 3*a* and 4 are suitable, as illustrated, for example, in FIGS. 5 and 6. According to FIG. 5, the propellant charge 2 is fashioned as an end burner ignited upon firing by the barrel gases and burning from the front toward the rear. The charge is disposed in the rearward zone of the ogive 14 and is supported toward the rear on the bottom part 4 and/or the contoured element 6 provided with the nozzle 7, firmly joined to the bottom part.

In the training projectile of FIG. 6, the solid propellant charge 2 is fashioned as an internal burner with a cylindrical initial burning area 3. The charge is inserted in the forward zone of the ogive 14 and is supported toward the rear on the bottom part 4 having the nozzle 7 located therein. This propellant charge 2 is not only arranged so that it is stable with respect to the acceleration, but also exhibits initially a degressive thrust characteristic without the requirement for additional contoured elements, although the latter can definitely be included, if desired. Here again, as in FIG. 5, the training projectile is fashioned as a hollow component open at the rear end 17.

Figure 7:
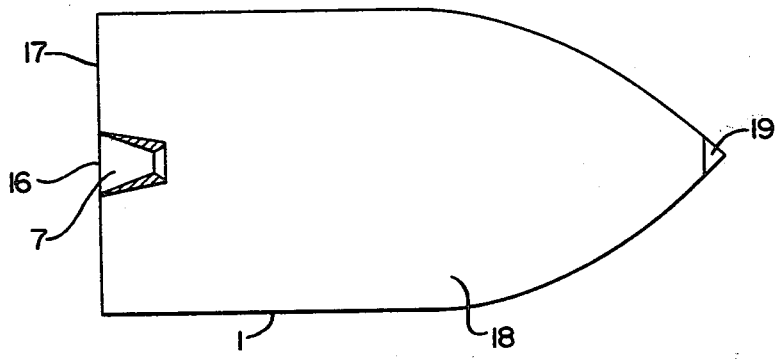

In some cases of utilizing the projectile, it can be sufficient to employ the interior of the training projectile as a storage means for a cold gas drive mechanism. FIG. 7 shows the structure of such a projectile with cold gas drive action. For this purpose, the training projectile is constructed as a container 18 with the wall 1 made, for example, of an aluminum alloy or steel, the external configuration of which corresponds to that of the original projectile. At the rearward, closed end 17, the container 18 is provided with the nozzle 7 sealed on the outside with the diaphragm 16 of, for example, an aluminum alloy or steel. The container 18 is filled with a compressed gas, such as air or nitrogen. The diaphragm 16 is designed so that it withstands the gas pressure within the container 18 until the instant of firing, but is disintegrated by the barrel gases upon the firing of the training projectile from a firearm, so that the compressed gas can escape toward the rear through the nozzle 7 and thus can become effective as a cold gas drive mechanism once the projectile has left the barrel. The container 18 can be filled with compressed gas during the manufacture of the projectile. However, in such a case difficulties can be encountered in ensuring a shelf life which will last in some cases for several years, depending on the quality of the leakproofness of the projectiles. Therefore, it is also possible to provide the container 18 with a gas fill valve 19 making it possible to fill the container 18, for example, only shortly before the firing of the training projectile.

Figure 8:
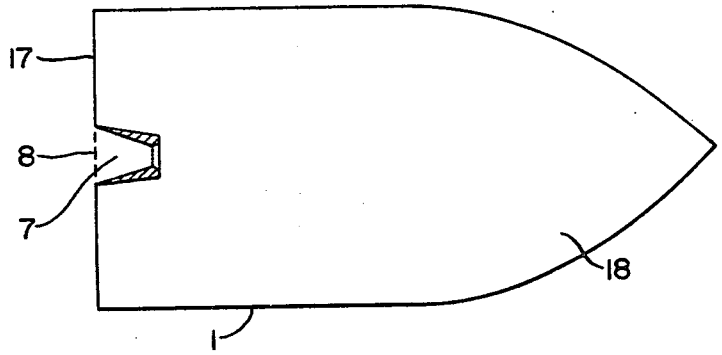

Furthermore, the barrel gases themselves can be utilized for driving the training projectile, so that the latter exhibits a hot gas drive mechanism. FIG. 8 shows such a training projectile fashioned as a container 18 with a nozzle 7 having an aperture 8 mounted to the rear end 17. The container 18 is filled during firing with the propellant gases within the barrel of the firearm via the nozzle 7. After the projectile has left the barrel, the gases again flow out of the container 18 toward the rear via the nozzle 7, thus producing the required thrust which has a degressive characteristic in correspondence with the dropping internal pressure in the container.

If the pressure within the barrel and the residence time of the training projectile therein are insufficient for filling the container to the required extent, the filling step can be enhanced, for example, by retaining the training projectile, for example by means of a shearing device within the barrel of the firearm so that it can only be set into motion at a higher pressure. In conjunction with a maximally uniform pressure of the propellant gases in the barrel and thus with a maximally high value of such pressure during the exiting of the projectile from the barrel, the time of pressure exposure can thereby be increased.

Figure 9:
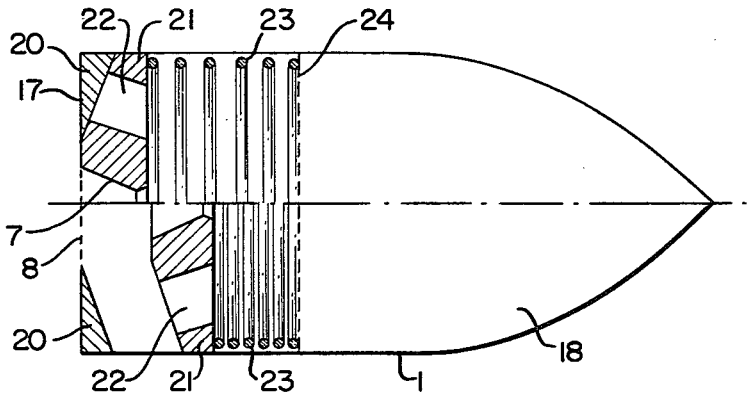

Additionally or in place thereof, the training projectile fashioned as a container 18 can also be provided, in accordance with FIG. 9, at its rear end 17 with a check valve having a valve seat 20 and a valve body 21. The valve body 21 has at least two filling openings 22 and is pressed, after the projectile has left the barrel, by means of the coil spring 23 supported toward the front on a connecting ring 24 of the container 18, against the valve seat 20 so that the filling openings 22 are closed. This closed position of the valve is illustrated in the top half of FIG. 9, whereas the lower half shows the valve in the open position within the barrel, wherein the valve body 21 has been pushed toward the front under the pressure effect of the barrel gases, so that the latter can flow into the interior of the container through the nozzle 7 and the inlet openings 22. The inlet cross section, in this way, is a multiple of the outlet or nozzle cross section.

Figure 10:
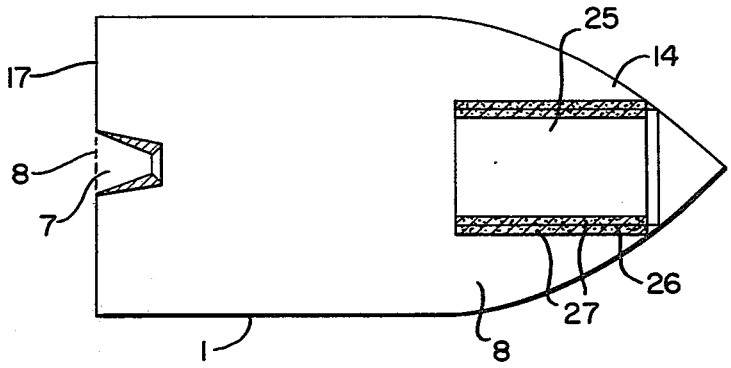

Furthermore, the training projectile, fashioned as a sealed container 18 with a nozzle 7 arranged at the rear end 17, can be provided according to FIG. 10 with an additional solid propellant charge 25 which is ignited by the barrel gases streaming into the container 18. The solid propellant charge 25 can be, for example, a so-called foil burner wherein a mechanical supporting fabric 26 with a circular, spiral-shaped, or like cross section is provided on both sides with respectively one thin, foil-like layer of propellant 27. The foil propellant charge attached in the zone of the ogive 14 has a brief burning time determined by its minor layer thickness, so that the container 18 is filled up relatively quickly with the barrel gases and the gases of the solid propellant charge 25 effective as a booster charge. In some cases, it is also possible to omit the additional filling effect and, if a separate ignitor is provided, it is also possible to make do without the igniting action of the barrel gases.

FIG. 11 shows a training projectile with a fluid or liquid supportive mass 28, for example water. Again, the projectile is fashioned as a container 18 having at its rear end face 29 an outlet opening 30 sealed off with a diaphragm 31 which can be destroyed during firing. A conduit 32 for the liquid follows the outlet opening 30 and extends toward the front into the zone of the ogive 14. At its open end, the conduit is conventionally equipped with a liquid inlet 33. In addition to the liquid 28, the container 18 also includes a pressure medium 34 which can, for example, be initially present in the container as a gas or is introduced into the container 18 only during firing in the form of the barrel gases. During firing, the liquid 28 fills the rear portion of the container 18 while the projectile undergoes the acceleration phase within the barrel of the firearm, so that the barrel gases, after disintegration of the diaphragm 31, flow via the conduit 32 and its free forward end into the front portion of the container 18 and can fill the latter. After the projectile has left the barrel of the firearm, the projectile is decelerated according to the arrow C, so that the liquid 28, which is denser as compared to the pressure medium 34, is accumulated in the forward portion of the container 18. Then, the pressure medium 34 presses from the rear onto the liquid 28, as shown in FIG. 11, and urges the liquid, in a manner not shown, via the conduit 32 toward the rear to the outside by way of the outlet opening 30.

The question of which one of the aforedescribed embodiments is suitably utilized in an individual case should preferably be solved by conducting a customary systems analysis in accordance with the respective requirements for accuracy of the representation of the ballistic trajectory of the original projectile. The use of the principle of this invention of a driven training projectile does not exclude the optionally simultaneous application of other, known functional principles for training ammunition of a shortened range.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. A training projectile having a flight path of substantially shorter distance than a corresponding live projectile and comprising an auxiliary drive means for causing the training projectile to exhibit a ballistic trajectory corresponding to the ballistic trajectory of a live projectile during the training flight phase of the training projectile travel, said auxiliary drive means serving for counteracting aerodynamic resistance to which the training projectile is exposed during the training flight phase of projectile travel, the training projectile being provided with a mass so that the ratio of the resultant axial force to the mass of the training projectile is at least approximately equal to the ratio of the resistance force to the mass of a corresponding live projectile during the training flight phase.

2. A training projectile according to claim 1, wherein the ratio of the resultant axial force to the mass of the training projectile is equal to the ratio of the resistance force to the mass of a corresponding live projectile.

3. A training projectile according to claim 1, wherein the mass of the training projectile varies along the travel path thereof.

4. A training projectile according to claim 1, wherein the auxiliary drive means is a rocket propulsion means.

5. A training projectile according to claim 4, comprising container means having a rearwardly directed end face and at least one nozzle arranged in the zone of the rearwardly directed end face.

6. A training projectile according to claim 5, wherein the container means is arranged for being filled up, during firing, with at least one of propellant gases of a propellant charge of the training projectile and of propellant gases of a solid propellant charge arranged in the interior of the container means.

7. A training projectile according to claim 5, wherein the auxiliary drive means includes propellant charge means for generating propellant gases exiting from the container means through the at least one nozzle.

8. A training projectile according to claim 5, wherein the auxiliary drive means includes compressed gas within the container means, the container means being responsive to the firing of the training projectile from the barrel of a firearm for enabling the compressed gas to exit through the at least one nozzle.

9. A training projectile according to claim 5, wherein the container means is arranged for filling with propellant gases during firing.

10. A training projectile according to claim 9, wherein the container means is provided with at least one check valve means which increases the inlet cross section for the propellant gases with respect to the outlet cross section of the at least one nozzle.

11. A training projectile according to claim 10, wherein the inlet cross section is increased by a multiple with respect to the outlet cross section.

12. A training projectile according to claim 10, wherein the at least one check valve means is responsive to gases generated in the barrel of a firearm for enabling entry of the barrel gases into the container means, the barrel gases exiting through the at least one nozzle.

13. A training projectile according to claim 12, wherein the at least one check valve means includes a valve body, a valve seat and means biasing the valve body against the valve seat, the check valve means being responsive to the barrel gases for overcoming the biasing means to permit entry of the barrel gases into the container means through the check valve means.

14. A training projectile according to claim 4, wherein the rocket propulsion means includes a solid propellant charge with a degressive thrust characteristic.

15. A training projectile according to claim 14, wherein the solid propellant charge is arranged within the training projectile in the zone of the forward portion thereof.

16. A training projectile according to claim 15, wherein the training projectile is provided with a bottom part, the solid propellant charge being supported toward the rear on the bottom part.

17. A training projectile according to claim 14, wherein the training projectile is provided with a bottom part, the solid propellant charge being supported toward the rear on the bottom part.

18. A training projectile according to claim 14, wherein the solid propellant charge is arranged in the zone of the rear portion of the training projectile.

19. A training projectile according to claim 18, wherein the training projectile is provided with a bottom part, the solid propellant charge being supported toward the rear on the bottom part.

20. A training projectile according to claim 14, wherein the training projectile is provided with at least one nozzle proximate to the solid propellant charge for enabling the propellant gases generated to exit therethrough.

21. A training projectile according to claim 4, comprising container means partially filled with a fluid, the container means having a rearwardly directed end face and an outlet opening arranged in the zone of the rearwardly directed end face, conduit means extending from the outlet opening towards the front of the container means, and a pressure medium in the container means for forcing the fluid in the container means through the conduit means toward the rear under the effect thereof.

22. A training projectile according to claim 21, further comprising means for sealing the outlet opening, the sealing means being responsive to firing of the training projectile for enabling the flow of fluid therethrough.

23. A training projectile according to claim 1, wherein said auxiliary drive means is effective for counteracting aerodynamic resistance to which the projectile is exposed only during the training flight phase of projectile travel.

24. A training projectile according to claim 1, wherein the training projectile is fired from the barrel of a firearm and is arranged for exhibiting a ballistic trajectory of a corresponding live projectile during the training flight phase in the travel of the training projectile from the barrel over the area of a training range.

25. A training projectile according to claim 1, wherein the training projectile is fired from the barrel of a firearm and the auxiliary drive means is effective for counteracting aerodynamic resistance to which the projectile is exposed during the travel of the projectile from the barrel over the area of a training range during the training flight phase of the projectile travel.

* * * * *